US012352261B2

(12) United States Patent
Li

(10) Patent No.: US 12,352,261 B2
(45) Date of Patent: Jul. 8, 2025

(54) MINIATURE VACUUM PUMP AND MINIATURE VACUUM DEVICE

(71) Applicant: Baifeng Li, Shenzhen (CN)

(72) Inventor: Baifeng Li, Shenzhen (CN)

( * ) Notice: Subject to any disclaimer, the term of this patent is extended or adjusted under 35 U.S.C. 154(b) by 0 days.

(21) Appl. No.: 18/864,433

(22) PCT Filed: Dec. 26, 2023

(86) PCT No.: PCT/CN2023/142053
§ 371 (c)(1),
(2) Date: Nov. 8, 2024

(87) PCT Pub. No.: WO2025/112147
PCT Pub. Date: Jun. 5, 2025

(65) Prior Publication Data

US 2025/0180009 A1 Jun. 5, 2025

(30) Foreign Application Priority Data

Nov. 30, 2023 (CN) ..... 202311627073.9
Dec. 12, 2023 (CN) ..... 202323414880.0

(51) Int. Cl.
*F04B 53/06* (2006.01)
*F04B 37/14* (2006.01)
(Continued)

(52) U.S. Cl.
CPC ..... *F04B 53/06* (2013.01); *F04B 37/14* (2013.01); *F04B 39/0055* (2013.01);
(Continued)

(58) Field of Classification Search
CPC ..... F04B 37/14; F04B 35/04; F04B 39/0055; F04B 39/10; F04B 39/102; F04B 39/12;
(Continued)

(56) References Cited

U.S. PATENT DOCUMENTS

2007/0140879 A1* 6/2007 Huang ..... F04B 45/022 417/472
2017/0102083 A1 4/2017 Lemmers
2018/0327125 A1* 11/2018 Song ..... C12H 1/16

FOREIGN PATENT DOCUMENTS

CN 2427691 Y 4/2001
CN 201021655 Y 2/2008
(Continued)

*Primary Examiner* — Dominick L Plakkoottam

(57) ABSTRACT

A miniature vacuum pump includes a collection and exhaust chamber, a driving motor, and a vacuum breaking assembly including an inlet hole extending through a bottom wall of the collection and exhaust chamber, a pressure plate movably fitting about the output shaft located in the collection and exhaust chamber and flexibly covering the inlet hole, a rotation member coaxially and fixedly mounted to the output shaft and located at a side of the pressure plate opposite to the bottom wall and forming a rotation frame, and a centrifugal swing rod rotatably mounted to the rotation frame through a rotation shaft perpendicular to the output shaft. A center of gravity of the centrifugal swing rod is set at an end away from the rotation member, and an opposite end of the centrifugal swing rod is bent and extended to form a pressing portion for abutting against the pressure plate.

20 Claims, 8 Drawing Sheets

(51) Int. Cl.

| | |
|---|---|
| ***F04B 39/00*** | (2006.01) |
| ***F04B 39/10*** | (2006.01) |
| ***F04B 45/04*** | (2006.01) |
| ***F04B 45/047*** | (2006.01) |

(52) U.S. Cl.
CPC ..... *F04B 39/10* (2013.01); *F04B 45/045* (2013.01); *F04B 45/047* (2013.01)

(58) Field of Classification Search
CPC ..... F04B 39/121; F04B 39/123; F04B 43/04; F04B 45/027; F04B 45/045; F04B 39/0005; F04B 39/14; F04B 53/06
See application file for complete search history.

(56) References Cited

FOREIGN PATENT DOCUMENTS

| | | | | | |
|---|---|---|---|---|---|
| CN | 202203073 | U | * | 4/2012 | |
| CN | 206942973 | U | * | 1/2018 | |
| CN | 210043842 | U | * | 2/2020 | ..... A47J 43/046 |
| CN | 111765070 | A | * | 10/2020 | ..... A47J 31/468 |
| CN | 111810388 | A | * | 10/2020 | |
| CN | 112523955 | A | | 3/2021 | |
| CN | 114909269 | A | * | 8/2022 | |
| CN | 217380826 | U | * | 9/2022 | |
| CN | 115681092 | A | | 2/2023 | |
| CN | 116696718 | A | * | 9/2023 | ..... F04B 37/14 |
| CN | 116906295 | A | * | 10/2023 | ..... F04B 35/04 |

* cited by examiner

MINIATURE VACUUM PUMP AND MINIATURE VACUUM DEVICE

FIELD OF THE PRESENT INVENTION

The present invention relates to the technical field of vacuum pumping devices and, more particularly to a miniature vacuum pump and a miniature vacuum device.

BACKGROUND OF THE PRESENT INVENTION

Existing small household appliances, such as small vacuum packaging machines and electric breast pumps, require vacuum pumping devices. Due to different performance indicators, such as power, vacuum degree, service life, noise, volume, and safety, large vacuum pumps and vacuum pumping devices widely used in industry or commerce are not suitable, and miniature vacuum pumping devices are required.

A current miniature vacuum device usually includes a miniature vacuum pump, an electromagnetic valve, and a controller. A suction nozzle of the vacuum pump is connected to a corresponding vacuum container through a corresponding suction pipeline. The electromagnetic valve is usually a three-way valve and is connected to the suction pipeline. A first port and a second port of the electromagnetic valve are respectively connected to the suction nozzle and the vacuum container, and a third port of the electromagnetic valve is connected to the outside. When vacuum is needed, the controller firstly controls the electromagnetic valve to connect the first port to the second port and close the third port, and then controls a driving motor of the vacuum pump to drive an exhaust assembly to operate to suck out the air inside the vacuum container, so as to achieve vacuum operation. When vacuum is not required, the controller controls the electromagnetic valve to connect the second port to the third port, allowing external air to enter the vacuum container.

However, in the specific implementation, the current miniature vacuum device uses the electromagnetic valve to achieve vacuum breaking operations on the vacuum container, and the electromagnetic valve is prone to exhaust vibrations during operation, resulting in significant noise, and moreover, the occupation volume and cost of the electromagnetic valve is relatively large, which is not conducive to the miniaturization of the miniature vacuum device and the reduction of production costs.

SUMMARY OF THE INVENTION

Technical Problem

Therefore, the technical problem to be solved by the embodiments of the present invention is to provide a miniature vacuum pump that can perform vacuum breaking operations without relying on electromagnetic valves.

The technical problem to be further solved by the embodiments of the present invention is to provide a miniature vacuum device that can achieve vacuum breaking without the need for electromagnetic valves, and can effectively reduce volume, production costs, and work noise.

Solutions to the Problem

To solve the above-mentioned technical problems, an embodiment of the present invention provides the following solutions. A miniature vacuum pump includes a collection and exhaust chamber defining an intake nozzle and an exhaust hole, a leather bowl assembly assembled in an inner space of the collection and exhaust chamber, a driving motor with an output shaft extending through a bottom wall of the collection and exhaust chamber to enter into the inner space and be connected to the leather bowl assembly so as to drive the leather bowl assembly to operate, and a vacuum breaking assembly.

The vacuum breaking assembly includes an inlet hole, a pressure plate, a rotation member, and a centrifugal swing rod.

The inlet hole extends through the bottom wall of the collection and exhaust chamber.

The pressure plate movably fits about a part of the output shaft located in the collection and exhaust chamber, and flexibly covers the inlet hole.

The rotation member is coaxially and fixedly mounted to the output shaft and located at a side of the pressure plate opposite to the bottom wall, and a rotation frame protrudes from a lateral side of the rotation member.

A middle of the centrifugal swing rod is rotatably mounted to the rotation frame at the lateral side of the rotation member through a rotation shaft, the rotation shaft is perpendicular to the output shaft, a center of gravity of the centrifugal swing rod is set at an end away from the rotation member, an end of the centrifugal swing rod close to the rotation member is bent and extended toward the pressure plate to form a pressing portion for abutting against the pressure plate.

Furthermore, the vacuum breaking assembly further comprises an elastic member with one end being fixed relative to the collection and exhaust chamber and the other end abutting against a side surface of the pressure plate facing the bottom wall, to abut against the pressure plate in a direction away from the bottom wall, so as to allow the inlet hole to communicate with the inner space of the collection and exhaust chamber.

Furthermore, a plurality of said rotation frames is symmetrically arranged on the lateral side of the rotation member about a central axis of the rotation member, and each rotation frame is rotatably equipped with one said centrifugal swing rod.

Furthermore, a gap is defined between the pressure plate and a bottom surface of the rotation member in an axial direction of the output shaft, and a distal end of the pressing portion is inserted into the gap and abutted against the bottom surface of the rotation member when the output shaft is not rotating.

Furthermore, a sealing gasket is provided at a position where the side surface of the pressure plate facing the bottom wall is directly opposite to the inlet hole.

Furthermore, an outer wall surface of the bottom wall is correspondingly recessed to form a noise reduction groove, one end of which communicates with an outer end opening of the inlet hole and the other end of which defines a slot on an outer side of the collection and exhaust chamber; wherein the noise reduction groove is filled with soundproof cotton.

Furthermore, the pressure plate defines a guide hole that is axially parallel to the output shaft, the bottom wall is correspondingly provided with a protruded guide rod that is parallel to the output shaft and correspondingly extends through the guide hole.

Furthermore, a middle of the pressure plate defines a through hole, and a support sleeve is fixedly assembled inside the through hole; the output shaft extends through a sleeve hole in a middle of the support sleeve and is movably arranged relative to the sleeve hole in the axial direction.

Furthermore, a middle of the bottom wall defines a stepped hole, One end of the stepped hole connected to the inner space of the collection and exhaust chamber is a thin diameter end, and the other end away from the collection and exhaust chamber is a thick diameter end; the output shaft extends into the inner space of the collection and exhaust chamber through the stepped hole; wherein a sealing gasket is also assembled inside the thick diameter end, one side of the sealing gasket is abutted against a connecting step surface between the thin diameter end and the thick diameter end, and a contact ring is protruded about an inner hole of the sealing gasket on an opposite side of the sealing gasket for correspondingly abutting against an end face of the driving motor.

Furthermore, the elastic member is a spiral compression spring that is correspondingly fitted about the output shaft, a protruded ring protrudes from a middle of the side surface of the pressure plate, surrounding the through hole; one end of the elastic member is fitted about the protruded ring, while the other end extends through the stepped hole and the inner hole of the sealing gasket and then is fitted about a shaft seat arranged on the end face of the driving motor for the output shaft extending through.

Furthermore, an outer wall surface of the bottom wall defines two positioning holes at opposite sides of the thick diameter end, and two positioning protrusions protrude from opposite sides of the sealing gasket, the positioning protrusions are correspondingly engaged in the positioning holes, to position the sealing gasket.

On the other hand, to solve the above-mentioned technical problems, an embodiment of the present invention further provides the following solutions. A miniature vacuum device includes a miniature vacuum pump as any one of the above-mentioned miniature vacuum pump, and a controller connected to the driving motor of the miniature vacuum pump, for controlling the operation state of the driving motor.

Beneficial Effects of the Invention

By adopting the above technical solution, embodiments of the present invention have at least the following beneficial effects. The miniature vacuum pump in the embodiments of the present invention adds a vacuum breaking component. Specifically, the bottom wall of the collection and exhaust chamber defines the inlet hole, and the inlet hole is flexibly covered by the pressure plate; when the miniature vacuum pump needs to perform vacuum pumping operation and starts the driving motor, because the center of gravity of the centrifugal swing rod is set at the end away from the rotation member, the output shaft of the driving motor rotates to drive the rotation member to rotate, causing the centrifugal swing rod to deflect about the rotation shaft under the action of centrifugal force; at this time, the pressing portion of the centrifugal swing rod close to the rotation member immediately abuts against the pressure plate, so that the pressure plate overcomes the elastic force of the elastic member and covers the inlet hole, thereby isolating the inner space of the collection and exhaust chamber from the outside atmosphere and achieving normal vacuum pumping operation; when the miniature vacuum pump needs to perform vacuum breaking operation and the driving motor is shut down, the output shaft of the driving motor and the rotation member stop rotating, the centrifugal force disappears, and the pressing portion of the centrifugal swing rod no longer applies pressure to the pressure plate; due to the pressure difference between the inner space of the collection and exhaust chamber and the outside atmosphere, the pressure plate is pushed open by the outside atmosphere, and the inlet hole is opened to allow the inner space of the collection and exhaust chamber to communicate with the outside atmosphere; the outside atmosphere enters the inner space of the collection and exhaust chamber through the inlet hole, achieving vacuum breaking operation without relying on electromagnetic valves, reducing production costs and working noise.

DETAILED DESCRIPTION OF THE PRESENT INVENTION

Figure 1:
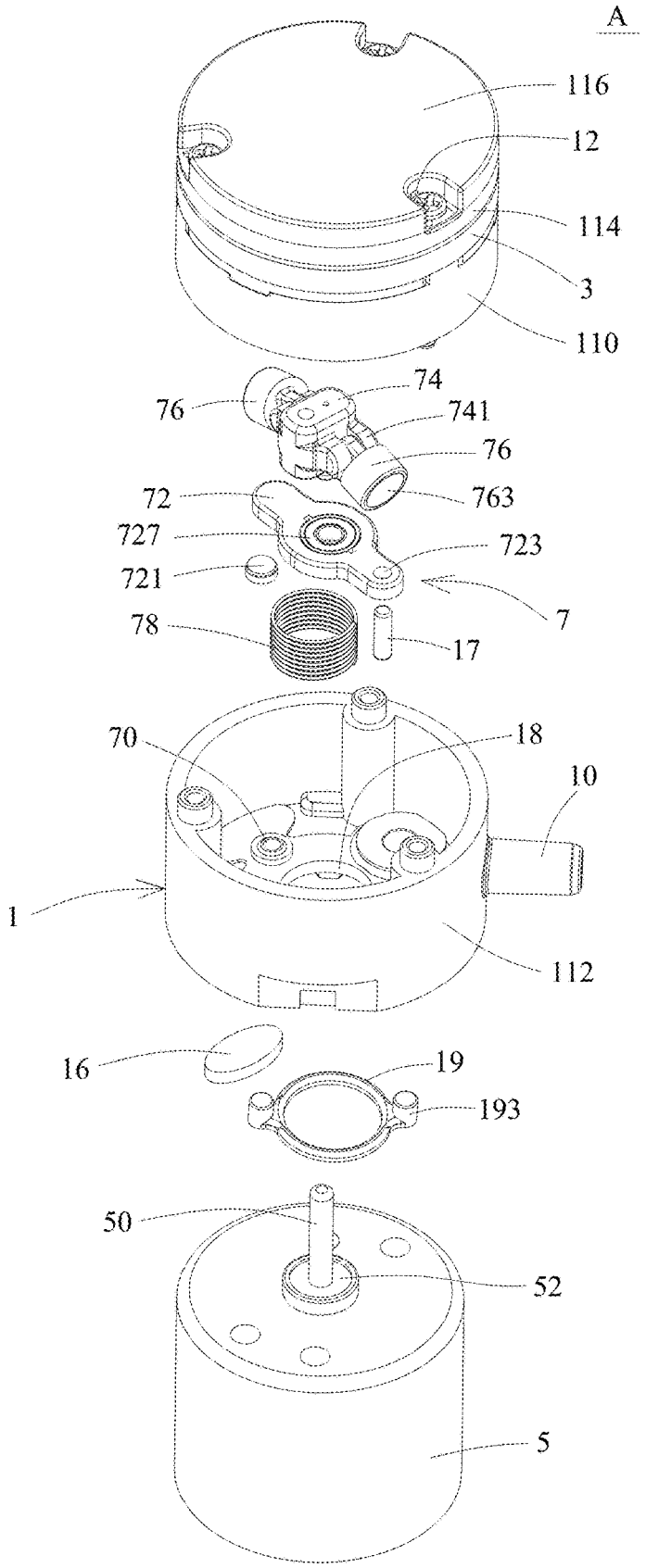
FIG. 1 is an exploded, isometric view of an embodiment of a miniature vacuum pump.
Figure 2:
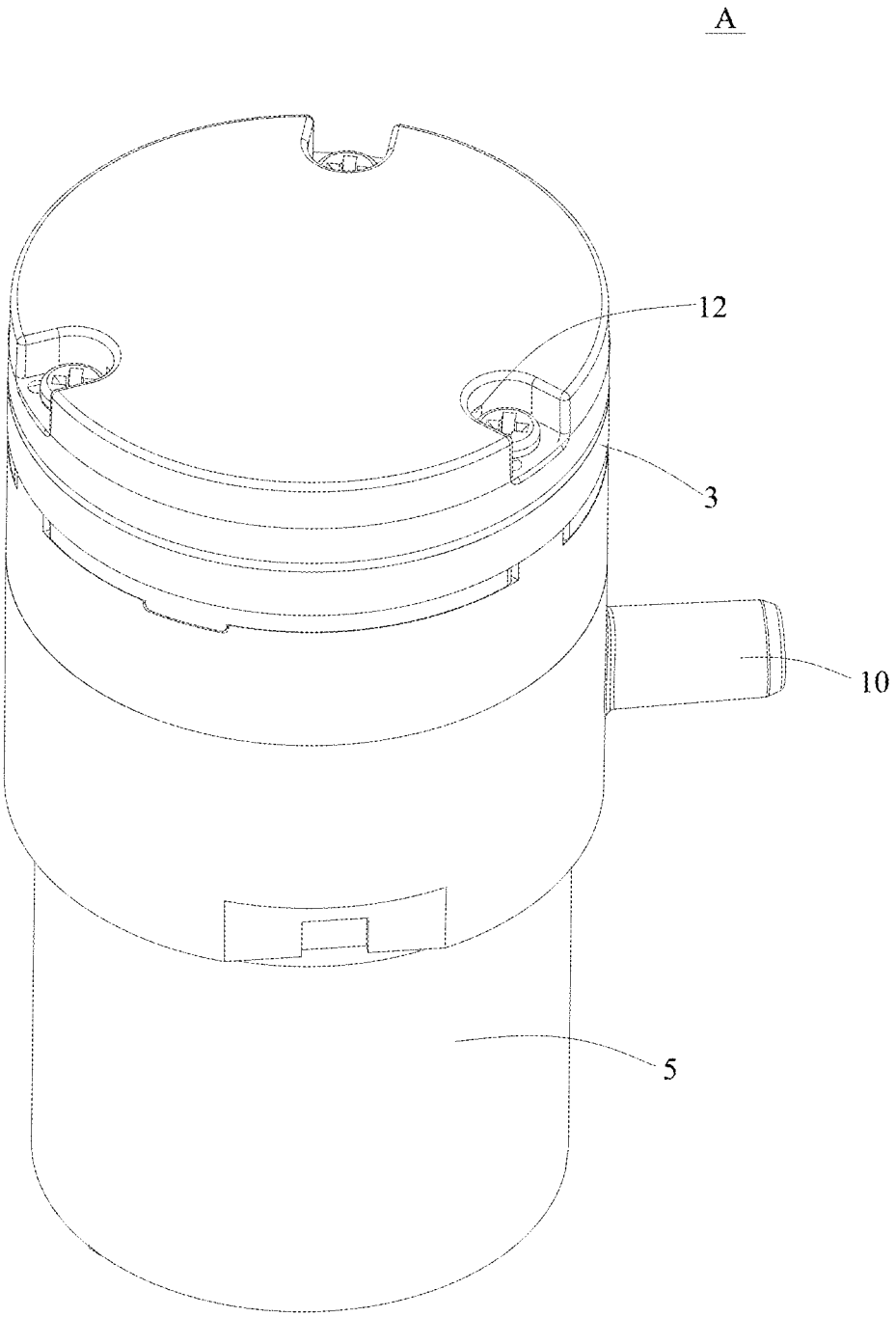
FIG. 2 is an assembled, isometric view of the miniature vacuum pump.
Figure 3:
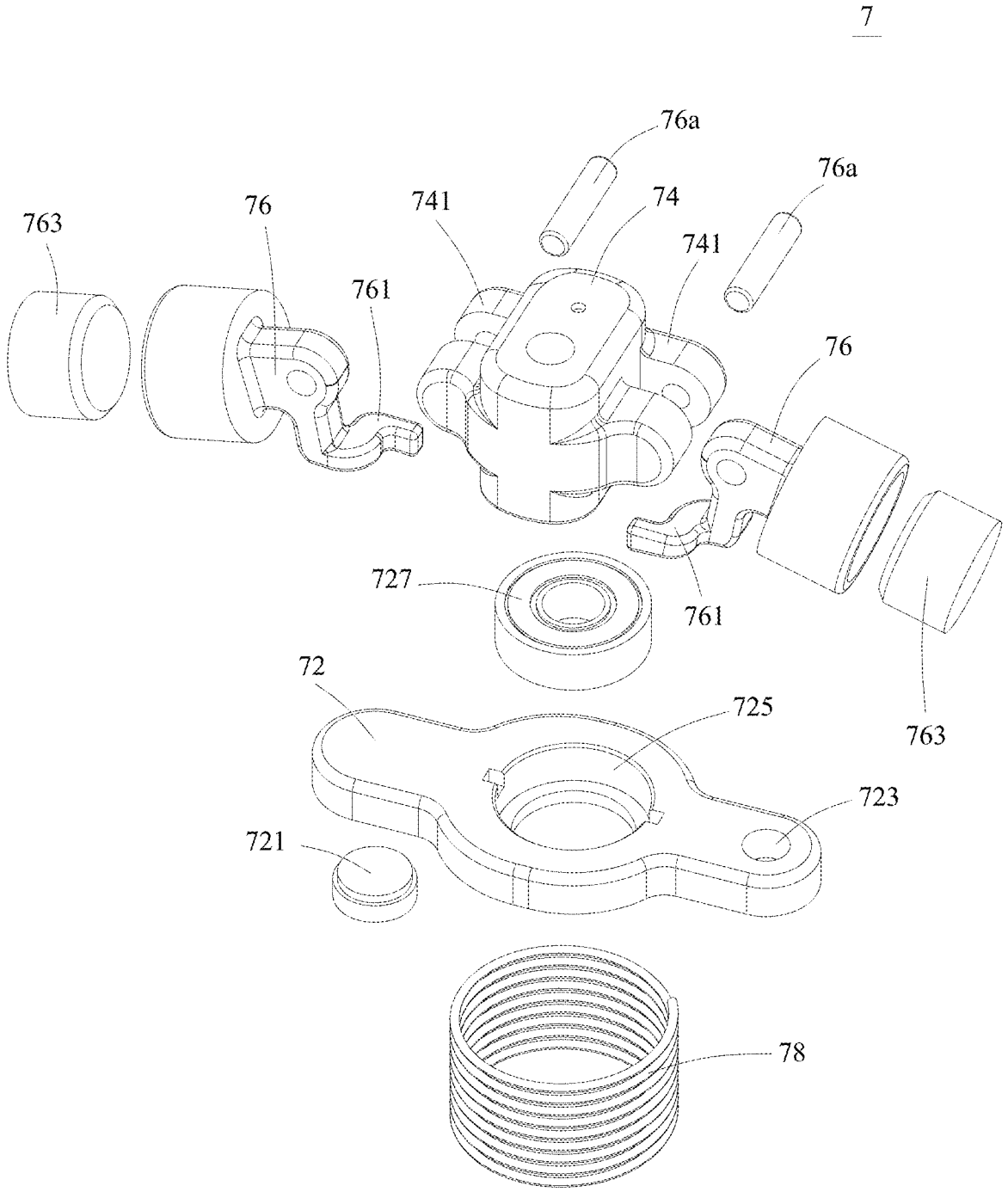
FIG. 3 is an exploded, isometric view of a vacuum breaking assembly.

The present application will be further described in detail below with reference to the accompanying drawings and embodiments. It should be understood that the following illustrative embodiments and illustrations are only used to explain the present invention and are not intended to limit the present invention, and that the embodiments of the present invention and the features of the embodiments can be combined with each other without conflict.

Referring to FIGS. 1-6, an embodiment of the present invention provides a miniature vacuum pump A, including a collection and exhaust chamber 1 defining an intake nozzle 10 and an exhaust hole 12, a leather bowl assembly 3 assembled in an inner space 1*a* of the collection and exhaust chamber 1, and a driving motor 5 with an output shaft 50 extending into the inner space 1*a* through a bottom wall 1*b* of the collection and exhaust chamber 1 and being connected to the leather bowl assembly 3 to drive the leather bowl assembly 3 to operate. The miniature vacuum pump also includes a vacuum breaking assembly 7, which includes an inlet hole 70, a pressure plate 72, a rotation member 74, and a centrifugal swing rod 76.

The inlet hole 70 extends through the bottom wall 1*b* of the collection and exhaust chamber 1.

The pressure plate 72 is movably fitted about a part of the output shaft 50 located in the collection and exhaust chamber 1, and flexibly covers the inlet hole 70.

The rotation member 74 is coaxially and fixedly assembled on the output shaft 50 and located at a side of the pressure plate 72 away from the bottom wall 1*b*. A rotation frame 741 extends from a lateral side of the rotation member 74.

A middle of the centrifugal swing rod 76 is rotatably mounted to the rotation frame 741 at the lateral side of the rotation member 74 through a rotation shaft 76*a*. The rotation shaft 76*a* is perpendicular to the output shaft 50. A center of gravity of the centrifugal swing rod 76 is set at an end away from the rotation member 74. An end of the centrifugal swing rod 76 close to the rotation member 74 is bent and extended toward the pressure plate 72 to form a pressing portion 761 for abutting against the pressure plate 72.

The miniature vacuum pump A in the embodiment adds the vacuum breaking assembly 7. Specifically, the inlet hole 70 is defined in the bottom wall of the collection and exhaust chamber 1, and the inlet hole 70 is flexibly covered by the pressure plate 72. When the miniature vacuum pump A needs to perform vacuum pumping operation and the driving motor 5 is started, because the center of gravity of the centrifugal swing rod 76 is set at the end away from the rotation member 74, the output shaft 50 of the driving motor rotates to drive the rotation member 74 to rotate, so as to cause the centrifugal swing rod 76 to deflect about the rotation shaft 76*a* under the action of centrifugal force. At this time, the pressing portion 761 of the centrifugal swing rod 76 close to the rotation member 74 immediately abuts against the pressure plate 72, thereby allowing the pressure plate 72 to overcome the elastic force of an elastic member 78 and then to cover the inlet hole 70, so as to isolate the inner space 1*a* of the collection and exhaust chamber 1 from the outside atmosphere, and achieve normal vacuum pumping operation. When the miniature vacuum pump A needs to perform vacuum breaking operation and the driving motor 5 is shut down, the output shaft 50 of the driving motor 5 and the rotation member 74 stop rotating, the centrifugal force disappears and the pressing portion 761 of the centrifugal swing rod 76 no longer applies abutting force on the pressure plate 72. Due to the pressure difference between the inner space 1*a* of the collection and exhaust chamber 1 and the outside atmosphere, the pressure plate 72 is pushed open by the outside atmosphere, and the air of the outside atmosphere enters the inner space 1*a* of the collection and exhaust chamber 1 through the inlet hole 70, achieving vacuum breaking operation without relying on electromagnetic valves, reducing production costs and working noise.

In specific implementation, it can be understood that when the output shaft 50 of the driving motor 5 rotates at a predetermined angular velocity to drive the centrifugal swing rod 76 to swing and push the pressure plate 72 to cover the inlet hole 70, the centrifugal swing rod 76 is in a state of force balance. Therefore, whether the miniature vacuum pump is in a tilted or inverted state, the output shaft 50 rotates at the predetermined angular velocity to drive the centrifugal swing rod 76 to swing, which will also cause the centrifugal swing rod 76 to swing to the corresponding position and balance. At this time, the centrifugal swing rod 76 also pushes the pressure plate 72 to cover the inlet hole 70.

In another embodiment of the present invention, as shown in FIGS. 1, 3, and 5-7, the vacuum breaking assembly 7 further includes the elastic member 78.

One end of the elastic member 78 is fixed relative to the collection and exhaust chamber 1, and the other end is abutted against a side surface of the pressure plate 72 facing the bottom wall 1*b*, used to abut against the pressure plate 72 in a direction away from the bottom wall 1*b* to allow the inlet hole 70 to communicate with the inner space 1*a* of the collection and exhaust chamber 1. In the embodiment, when the output shaft 50 of the driving motor 5 and the rotation member 74 stop rotating, the centrifugal force disappears, and the pressing portion 761 of the centrifugal swing rod 76 no longer applies abutting force on the pressure plate 72. The pressure plate 72 returns to its initial position with the assistance of the elastic force of the elastic member 78, and the inlet hole 70 opens to allow the inner space 1*a* of the collection and exhaust chamber 1 to communicate with the outside atmosphere. The air of the outside atmosphere enters the inner space 1*a* of the collection and exhaust chamber 1 through the inlet hole 70, achieving vacuum breaking operation.

In another embodiment of the present invention, as shown in FIGS. 1-6, a plurality of rotation frames 741 is symmetrically arranged on the lateral side of the rotation member 74 about a central axis of the rotation member 74, and each rotation frame 741 is rotatably equipped with one centrifugal swing rod 76. In the embodiment, the centrifugal swing rods 76 are symmetrically arranged on the lateral side of the rotation member 74, and thus when the rotation member 74 rotates under the drive of the output shaft 50, the centrifugal swing rods 76 on the lateral side can always symmetrically apply abutting force on the pressure plate 72, so that the pressure plate 72 is stably held in the position covering the inlet hole 70, ensuring the sealing of the pressure plate 72 to the inlet hole 70.

In specific implementation, the rotation frames 741 are symmetrically arranged on the lateral side of the rotation member 74, and each rotation frame 741 is rotatably mounted with one said centrifugal swing rod 76.

Figure 4:
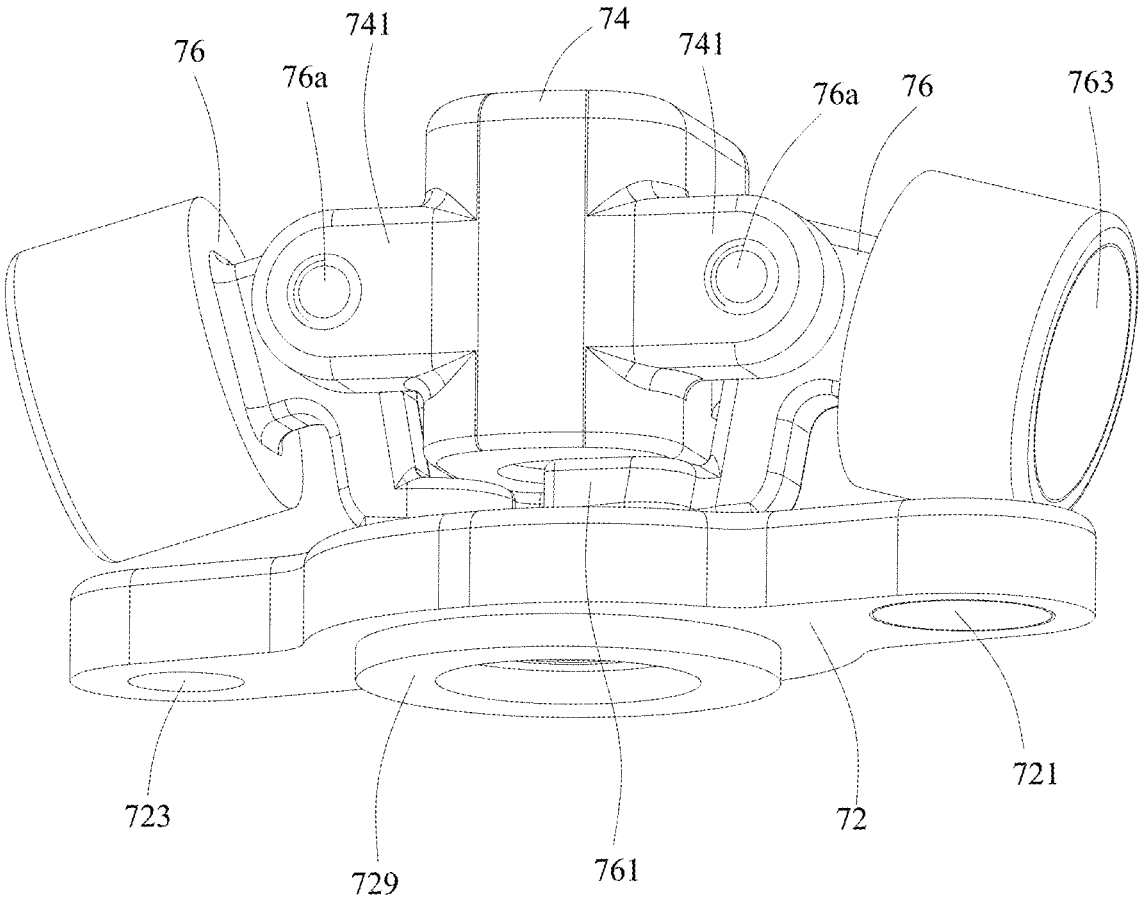
FIG. 4 is an assembled, isometric view of the vacuum breaking assembly except for an elastic member.
Figure 5:
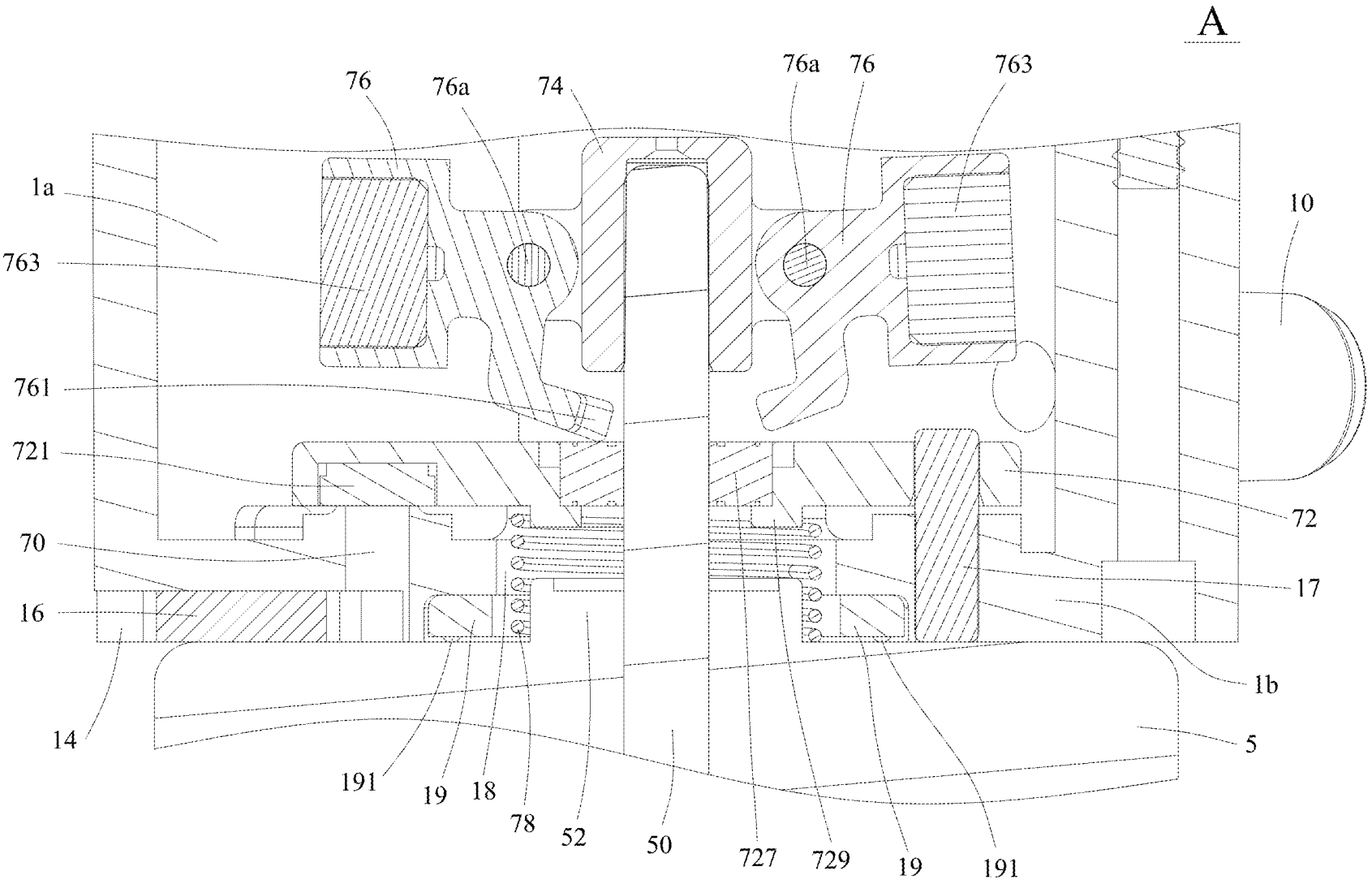
FIG. 5 is a cross-sectional view of the vacuum breaking assembly, showing a pressure plate covering an inlet hole.
Figure 6:
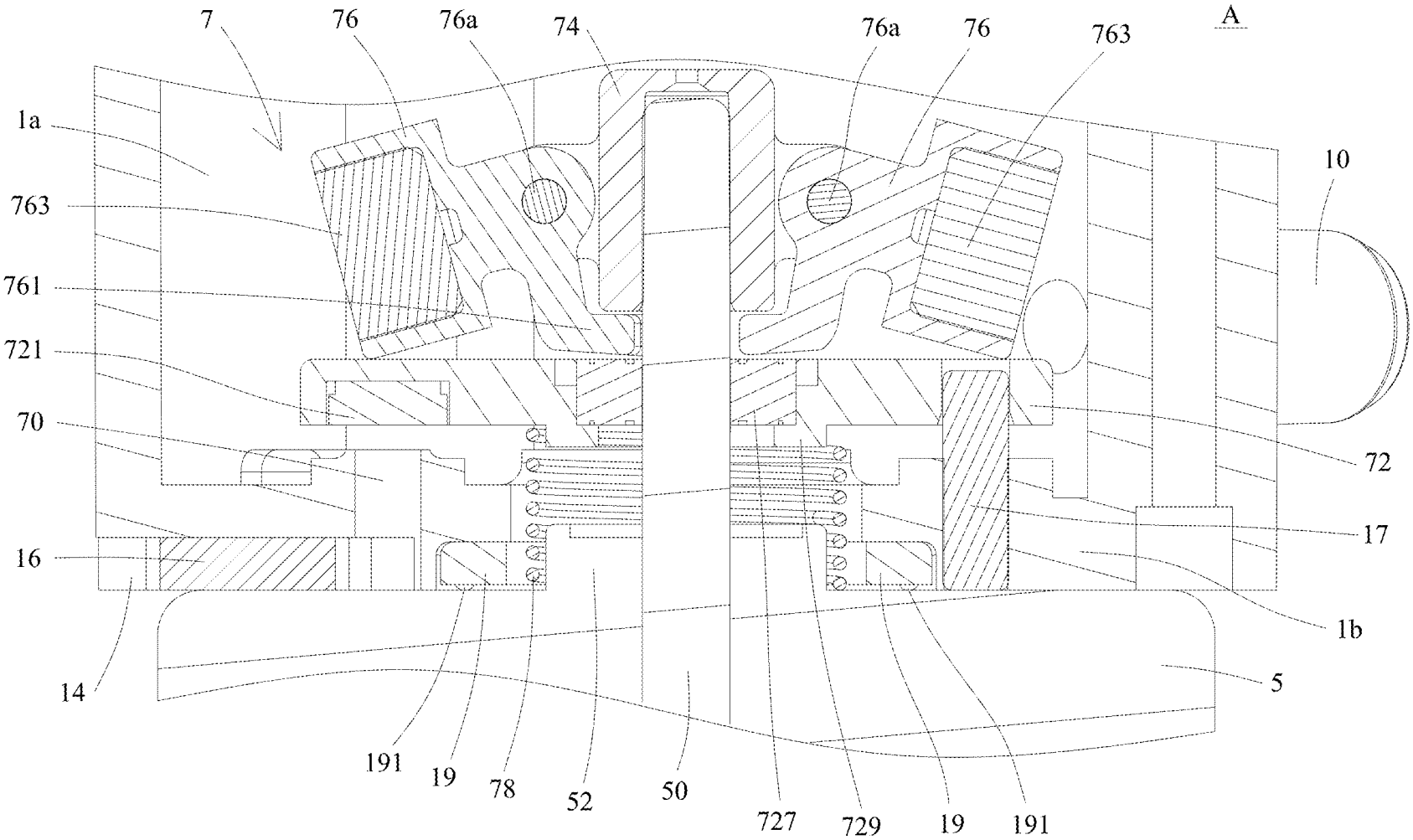
FIG. 6 is a cross-sectional view of the vacuum breaking assembly, showing the pressure plate opening the inlet hole.
Figure 7:
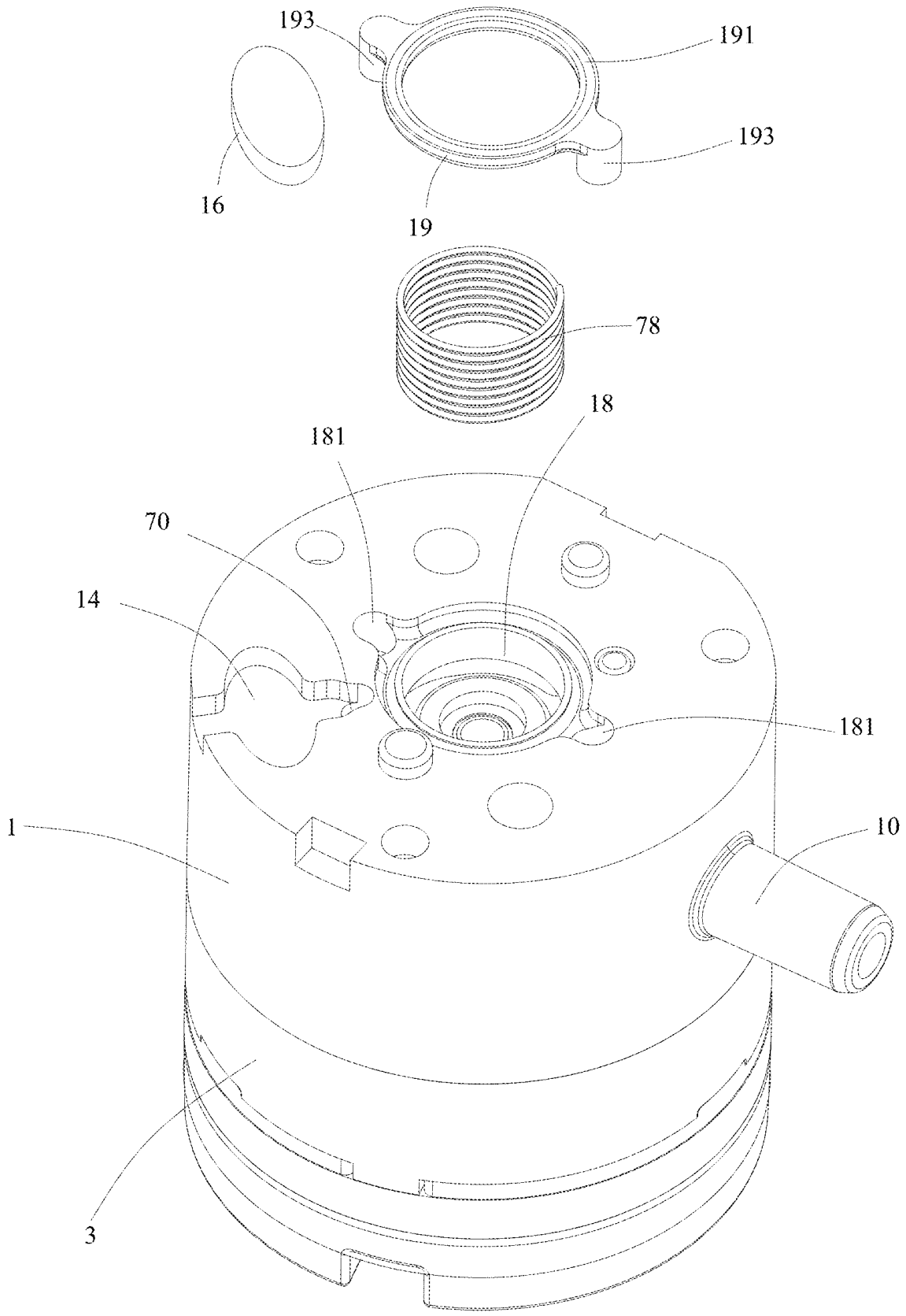
FIG. 7 is an exploded, inverted view of the miniature vacuum pump.

In another embodiment of the present invention, as shown in FIG. 4, a gap is defined between the pressure plate 72 and a bottom surface of the rotation member 74 in the axial direction of the output shaft 50, and a distal end of the pressing portion 761 is inserted into the gap and abutted against the bottom surface of the rotation member 74 when the output shaft 50 is not rotating. In the embodiment, when the output shaft 50 is not rotating, the distal end of the pressing portion 761 is also abutted against the bottom surface of the rotation member 74 to prevent the pressure plate 72 from covering the inlet hole 70 because of the weight of the top of the centrifugal swing rod 76 being too heavy. The centrifugal swing rod 76 is assembled with a counterweight 763 at the end away from the rotation member 74. By adding the counterweight 763, the center of gravity of the centrifugal swing rod 76 can be effectively adjusted to be set at the end away from the rotation member 74.

In another embodiment, as shown in FIGS. 1-6, a sealing gasket 721 is provided at the position where the side surface of the pressure plate 72 facing the bottom wall 1*b* is directly opposite to the inlet hole 70. In the embodiment, the sealing gasket 721 is also installed to effectively enhance the sealing effect of the pressure plate 72 on the inlet hole 70, ensuring the airtightness of the miniature vacuum pump during vacuum pumping operations. In specific implementation, the bottom surface of the pressure plate 72 defines a recess, and the sealing gasket 721 is embedded in the recess.

In another embodiment of the present invention, as shown in FIGS. 4-7, an outer wall surface of the bottom wall 1*b* is correspondingly recessed to form a noise reduction groove 14, one end of which communicates with an outer end opening of the inlet hole 70 and the other end of which defines a slot on the outer wall surface of the collection and exhaust chamber 1. The noise reduction groove 14 is filled with soundproof cotton 16. In the embodiment, the noise reduction groove 14 is also defined, and the soundproof cotton 16 is filled in the noise reduction groove 14. When the miniature vacuum pump performs vacuum breaking operation, the air of the external atmosphere rapidly enters the collection and exhaust chamber 1 through the noise reduction groove 14 and the inlet hole 70. On one hand, the soundproof cotton 16 can effectively reduce the airflow noise during intake, and on the other hand, it can effectively prevent external foreign objects from entering the collection and exhaust chamber 1 with the external atmosphere.

In another embodiment of the present invention, as shown in FIGS. 1-6, the pressure plate 72 also defines a guide hole 723 that is axially parallel to the output shaft 50. The bottom wall 1*b* is correspondingly provided with a protruded guide rod 17 that is parallel to the output shaft 50 and correspondingly extends through the guide hole 723. In the embodiment, the pressure plate 72 slidably fits about the guide rod 17 through the guide hole 723 and is slidable from top to bottom along the guide rod 17, which can effectively guide the up and down movement of the pressure plate 72. In specific implementation, a bottom end of the guide rod 17 is inserted and fixed in a predetermined positioning hole in the bottom wall 1*b*.

In another embodiment of the present invention, as shown in FIGS. 1-6, a middle of the pressure plate 72 defines a through hole 725, and a support sleeve 727 is fixedly assembled inside the through hole 725. The output shaft 50 extends through a sleeve hole defined in a middle of the support sleeve 727 and is movably arranged relative to the sleeve hole in the axial direction. In the embodiment, the support sleeve 727 is arranged in the through hole 725 in the middle of the pressure plate 72, to ensure the normal rotation of the output shaft 50 in the middle of the pressure plate 72, avoiding interference between the two and effectively supporting the pressure plate 72. In specific implementation, the support sleeve 727 can be a ball bearing or a support washer.

In another embodiment of the present invention, as shown in FIGS. 1-7, a middle of the bottom wall 1*b* defines a stepped hole 18. One end of the stepped hole 18 connected to the inner space 1*a* of the collection and exhaust chamber 1 is a thin diameter end, and the other end away from the collection and exhaust chamber 1 is a thick diameter end. The output shaft 50 extends into the inner space 1*a* of the collection and exhaust chamber 1 through the stepped hole. A sealing gasket 19 is also assembled inside the thick diameter end. One side of the sealing gasket 19 is abutted against a connecting step surface between the thin diameter end and the thick diameter end, and a contact ring 191 is protruded about an inner hole of the sealing gasket 19 on the opposite side for correspondingly abutting against an end face of the driving motor 5. In the embodiment, the bottom wall 1*b* defines the stepped hole 18, and the sealing gasket 19 is installed in the stepped hole 18. When the output shaft 50 extends into the inner space 1*a* of the collection and exhaust chamber 1 through the stepped hole 18, the sealing of the collection and exhaust chamber 1 is ensured. Moreover, the sealing gasket 19 has the contact ring 191, which effectively enhances the sealing performance between the sealing gasket 19 and the driving motor 5.

In another embodiment of the present invention, as shown in FIGS. 1-7, the elastic member 78 is a spiral compression spring that is correspondingly fitted about the output shaft 50. A protruded ring 729 protrudes from a middle of a side surface of the pressure plate 72, surrounding the through hole 725. One end of the elastic member 78 is fitted about the protruded ring 729, while the other end extends through the stepped hole 18 and the inner hole of the sealing gasket 19 and then is fitted about a shaft seat 52 arranged on the end face of the driving motor 5 for the output shaft 50 extending through. In the embodiment, the elastic member 78 adopts the spiral compression spring that is fitted about the output shaft 50, its structure is simple, and the two ends of the elastic member 78 are respectively abutted against the pressure plate 72 and the shaft seat 52 of the driving motor 5, which can facilitate the elastic pushing force of the elastic member 78 on the pressure plate 72. Moreover, by setting the protruded ring 729, the positioning of the end of the elastic member 78 is effectively achieved.

In another embodiment of the present invention, as shown in FIGS. 1-7, the outer wall surface of the bottom wall 1*b* also defines two positioning holes 181 at opposite sides of the thick diameter end, and two positioning protrusions 193 protrude from opposite sides of the sealing gasket 19. The positioning protrusions 193 are correspondingly engaged in the positioning holes 181, to position the sealing gasket 19. In the embodiment, the positioning protrusions 193 are correspondingly engaged in the positioning holes 181, to position the sealing gasket 19 in the thick diameter end of the stepped hole 18, avoiding the sealing gasket 19 from easily falling out during assembly.

Figure 8:
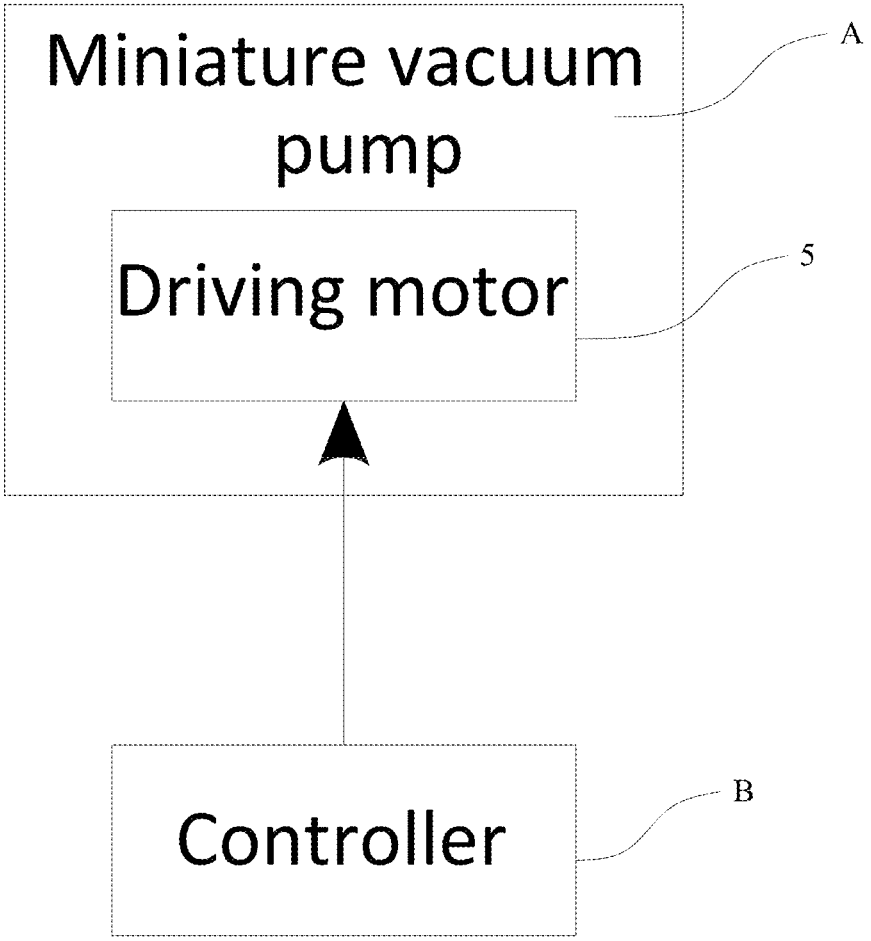
FIG. 8 is a module schematic diagram of a miniature vacuum device.

On the other hand, referring to FIG. 8, an embodiment of the present invention provides a miniature vacuum device, including a miniature vacuum pump A, and a controller B connected to the driving motor 5 of the miniature vacuum pump A for controlling the operation state of the driving motor 5. The miniature vacuum pump is the miniature vacuum pump as described in the above embodiments. In the embodiment, the miniature vacuum device adopts the above-mentioned miniature vacuum pump A, which can effectively reduce the volume, production cost, and operation noise.

In addition, the collection and exhaust chamber 1 includes a cylinder body 110 with several vertically communicated and mutually isolated cylinder chambers, a bottom shell 112 and a valve plate 114 respectively sealed and connected to bottom and top ends of the cylinder body 110, and a top cover 116 sealed and connected to a top end of the valve plate 114. The intake nozzle 10 and the inlet hole 70 are both defined in the bottom shell 112, and the vacuum breaking assembly 7 is assembled inside the bottom shell 112. The output shaft of the driving motor extends into the bottom shell from the bottom surface of the bottom shell, and the intake nozzle is located on the top cover. The valve plate defines an airflow hole and an umbrella for flexibly covering an exhaust end of the airflow hole. The leather bowl assembly includes a swing frame with a plurality of piston rods and a plurality of interconnected leather bowls. The piston rods and the leather bowls are correspondingly extended in the cylinder chambers from the bottoms and tops of the cylinder chambers and interlocked in the cylinder chambers. The bottom end of the swing frame is provided on an eccentric shaft, and the bottom end of the eccentric shaft is fixed on the rotation member 74. The central axel of the eccentric shaft and the output shaft 50 are inclined to each other. Multiple parts located outside the cylinder chamber are clamped and fixed by the valve plate and the cylinder body.

The embodiments of the present invention have been described above with reference to the accompanying drawings, but the present invention is not limited to the specific implementations described above, and the specific implementations described above are only schematic and not limiting. Under the enlightenment of this invention, many forms can be made without departing from the scope of this invention and the scope of protection of the claims, and these are all included in the scope of protection of this invention.

What is claimed is:

1. A miniature vacuum pump, comprising:

a collection and exhaust chamber defining an intake nozzle and an exhaust hole;

a leather bowl assembly assembled in an inner space of the collection and exhaust chamber;

a driving motor with an output shaft extending through a bottom wall of the collection and exhaust chamber to enter into the inner space and be connected to the leather bowl assembly, so as to drive the leather bowl assembly to operate; and a vacuum breaking assembly comprising:

an inlet hole extending through the bottom wall of the collection and exhaust chamber;

a pressure plate movably fitting about a part of the output shaft located in the collection and exhaust chamber, and flexibly covering the inlet hole;

a rotation member coaxially and fixedly mounted to the output shaft and located at a side of the pressure plate opposite to the bottom wall, wherein a rotation frame protrudes from a lateral side of the rotation member; and a centrifugal swing rod with a middle being rotatably mounted to the rotation frame at the lateral side of the rotation member through a rotation shaft; wherein the rotation shaft is perpendicular to the output shaft, a center of gravity of the centrifugal swing rod is set at an end away from the rotation member, an end of the centrifugal swing rod close to the rotation member is bent and extended toward the pressure plate to form a pressing portion for abutting against the pressure plate.

2. The miniature vacuum pump of claim 1, wherein the vacuum breaking assembly further comprises an elastic member with one end being fixed relative to the collection and exhaust chamber and the other end abutting against a side surface of the pressure plate facing the bottom wall, to abut against the pressure plate in a direction away from the bottom wall, so as to allow the inlet hole to communicate with the inner space of the collection and exhaust chamber.

3. The miniature vacuum pump of claim 1, wherein a plurality of said rotation frames is symmetrically arranged on the lateral side of the rotation member about a central axis of the rotation member, and each rotation frame is rotatably equipped with one said centrifugal swing rod.

4. The miniature vacuum pump of claim 1, wherein a gap is defined between the pressure plate and a bottom surface of the rotation member in an axial direction of the output shaft, and a distal end of the pressing portion is inserted into the gap and abutted against the bottom surface of the rotation member when the output shaft is not rotating.

5. The miniature vacuum pump of claim 3, wherein a gap is defined between the pressure plate and a bottom surface of the rotation member in an axial direction of the output shaft, and a distal end of the pressing portion is inserted into the gap and abutted against the bottom surface of the rotation member when the output shaft is not rotating.

6. The miniature vacuum pump of claim 1, wherein a sealing gasket is provided at a position where the side surface of the pressure plate facing the bottom wall is directly opposite to the inlet hole.

7. The miniature vacuum pump of claim 1, wherein an outer wall surface of the bottom wall is correspondingly recessed to form a noise reduction groove, one end of which communicates with an outer end opening of the inlet hole and the other end of which defines a slot on an outer side of the collection and exhaust chamber; wherein the noise reduction groove is filled with soundproof cotton.

8. The miniature vacuum pump of claim 1, wherein the pressure plate defines a guide hole that is axially parallel to the output shaft, the bottom wall is correspondingly provided with a protruded guide rod that is parallel to the output shaft and correspondingly extends through the guide hole.

9. The miniature vacuum pump of claim 1, wherein a middle of the pressure plate defines a through hole, and a support sleeve is fixedly assembled inside the through hole; the output shaft extends through a sleeve hole in a middle of the support sleeve and is movably arranged relative to the sleeve hole in the axial direction.

10. The miniature vacuum pump of claim 2, wherein a middle of the pressure plate defines a through hole, and a support sleeve is fixedly assembled inside the through hole; the output shaft extends through a sleeve hole in a middle of the support sleeve and is movably arranged relative to the sleeve hole in the axial direction.

11. The miniature vacuum pump of claim 10, wherein a middle of the bottom wall defines a stepped hole, one end of the stepped hole connected to the inner space of the collection and exhaust chamber is a thin diameter end, and the other end away from the collection and exhaust chamber is a thick diameter end; the output shaft extends into the inner space of the collection and exhaust chamber through the stepped hole; wherein a sealing gasket is also assembled inside the thick diameter end, one side of the sealing gasket is abutted against a connecting step surface between the thin diameter end and the thick diameter end, and a contact ring is protruded about an inner hole of the sealing gasket on an opposite side of the sealing gasket for correspondingly abutting against an end face of the driving motor.

12. The miniature vacuum pump of claim 11, wherein the elastic member is a spiral compression spring that is correspondingly fitted about the output shaft, a protruded ring protrudes from a middle of the side surface of the pressure plate, surrounding the through hole; one end of the elastic member is fitted about the protruded ring, while the other end extends through the stepped hole and the inner hole of the sealing gasket and then is fitted about a shaft seat arranged on the end face of the driving motor for the output shaft extending through.

13. The miniature vacuum pump of claim 1, wherein a middle of the bottom wall defines a stepped hole, one end of the stepped hole connected to the inner space of the collection and exhaust chamber is a thin diameter end, and the other end away from the collection and exhaust chamber is a thick diameter end; the output shaft extends into the inner space of the collection and exhaust chamber through the stepped hole; wherein a sealing gasket is also assembled inside the thick diameter end, one side of the sealing gasket is abutted against a connecting step surface between the thin diameter end and the thick diameter end, and a contact ring is protruded about an inner hole of the sealing gasket on an opposite side of the sealing gasket for correspondingly abutting against an end face of the driving motor.

14. The miniature vacuum pump of claim 11, wherein an outer wall surface of the bottom wall defines two positioning holes at opposite sides of the thick diameter end, and two positioning protrusions protrude from opposite sides of the sealing gasket, the positioning protrusions are correspondingly engaged in the positioning holes, to position the sealing gasket.

15. A miniature vacuum device comprising:

a miniature vacuum pump, wherein the miniature vacuum pump is the miniature vacuum pump of claim 1; and a controller connected to the driving motor of the miniature vacuum pump, for controlling the operation state of the driving motor.

16. The miniature vacuum pump of claim 2, wherein a plurality of said rotation frames is symmetrically arranged on the lateral side of the rotation member about a central axis of the rotation member, and each rotation frame is rotatably equipped with one said centrifugal swing rod.

17. The miniature vacuum pump of claim 2, wherein a gap is defined between the pressure plate and a bottom surface of the rotation member in an axial direction of the output shaft, and a distal end of the pressing portion is inserted into the gap and abutted against the bottom surface of the rotation member when the output shaft is not rotating.

18. The miniature vacuum pump of claim 2, wherein a sealing gasket is provided at a position where the side surface of the pressure plate facing the bottom wall is directly opposite to the inlet hole.

19. The miniature vacuum pump of claim 2, wherein an outer wall surface of the bottom wall is correspondingly recessed to form a noise reduction groove, one end of which communicates with an outer end opening of the inlet hole and the other end of which defines a slot on an outer side of the collection and exhaust chamber; wherein the noise reduction groove is filled with soundproof cotton.

20. The miniature vacuum pump of claim 2, wherein the pressure plate defines a guide hole that is axially parallel to the output shaft, the bottom wall is correspondingly provided with a protruded guide rod that is parallel to the output shaft and correspondingly extends through the guide hole.

* * * * *